United States Patent [19]

Golynsky et al.

[11] Patent Number: 5,029,940

[45] Date of Patent: Jul. 9, 1991

[54] CHAIR TILT AND CHAIR HEIGHT CONTROL APPARATUS

[75] Inventors: Arkady Golynsky, Allentown; Donald A. Wimmer, Palm; Bryan B. Bray, Jr., Emmaus; Robert A. Melhuish, East Greenville, all of Pa.

[73] Assignee: Westinghouse Electric Corporation, Pittsburgh, Pa.

[21] Appl. No.: 465,342

[22] Filed: Jan. 16, 1990

[51] Int. Cl.[5] ..... A47C 1/024

[52] U.S. Cl. ..... 297/301; 297/302; 297/304

[58] Field of Search ..... 297/300–304

[56] References Cited

U.S. PATENT DOCUMENTS

| | | | |
|---|---|---|---|
| 3,669,499 | 6/1972 | Semplonius et al. . | |
| 3,813,073 | 5/1974 | Mohr et al. . | |
| 3,851,920 | 12/1974 | Harris et al. . | |
| 3,881,772 | 5/1975 | Mohrman . | |
| 3,904,242 | 9/1975 | Koepke et al. . | |
| 3,947,068 | 3/1976 | Buhk . | |
| 3,964,789 | 6/1976 | Platner et al. . | |
| 3,983,614 | 10/1976 | Koepke et al. . | |
| 4,314,728 | 2/1982 | Faiks . | |
| 4,328,943 | 5/1982 | Eldon, III . | |
| 4,479,679 | 10/1984 | Fries et al. . | |
| 4,494,795 | 1/1985 | Roossien et al. . | |
| 4,555,085 | 11/1985 | Bauer et al. | 297/304 |
| 4,570,895 | 2/1986 | Whitwam et al. . | |
| 4,641,885 | 2/1987 | Brauning . | |
| 4,652,050 | 3/1987 | Stevens . | |
| 4,709,963 | 12/1987 | Uecker et al. | 297/300 |
| 4,720,142 | 1/1988 | Holdredge et al. | 297/302 |
| 4,744,603 | 5/1988 | Knoblock | 297/300 |
| 4,756,575 | 7/1988 | Dicks . | |
| 4,783,121 | 11/1988 | Luyk et al. . | |

FOREIGN PATENT DOCUMENTS

| | | |
|---|---|---|
| 0063860 | 7/1986 | European Pat. Off. . |
| 7428281 | 11/1974 | Fed. Rep. of Germany . |
| 1957493 | 3/1977 | Fed. Rep. of Germany . |
| 2940250 | 12/1981 | Fed. Rep. of Germany . |
| 3534496 | 11/1986 | Fed. Rep. of Germany . |
| 3528335 | 2/1987 | Fed. Rep. of Germany . |
| 3605809 | 8/1987 | Fed. Rep. of Germany . |
| 8617736 | 11/1987 | Fed. Rep. of Germany . |
| 3617623 | 12/1987 | Fed. Rep. of Germany . |
| 3537203 | 3/1988 | Fed. Rep. of Germany . |
| 3635044 | 9/1988 | Fed. Rep. of Germany . |

*Primary Examiner*—Peter R. Brown

*Attorney, Agent, or Firm*—Mason, Fenwick & Lawrence

[57] ABSTRACT

A tilt control mechanism that is mounted to the underside of a chair bottom, and permits the user or sitter to selectively control the chair height, as well as the degree of chair tilt. A tension adjustment mechanism is provided to permit the user to change the amount of spring tension exerted against the chair bottom when the chair is tilted back. Finally, a structural support is provided which interconnects the seat bottom with the tilt mechanism, and transmits downwardly-exerted weight to the mechanism. Each of these four mechanisms comprises a number of parts seated within a die cast enclosure or housing.

7 Claims, 6 Drawing Sheets

CHAIR TILT AND CHAIR HEIGHT CONTROL APPARATUS

BACKGROUND OF THE INVENTION

1. Field of the Invention

The present invention relates to a tilt control mechanism for use in an adjustable chair.

2. Brief Description of the Prior Art

In today's office environment, great emphasis is placed on worker comfort. To this end, designers are not only interested in the aesthetic look of office furniture, but also its functionality. One aspect of office furniture that has undergone great change is that of chairs.

Early designers of chairs were concerned more with aesthetic looks then functionality. Today there is a conscious blending of design and functionality to take into account many features including the general lumbar curve of the user, release of pressure points about the body, the ability of the frame to blend with the sitter, and the ability of the chair to accommodate the movements of the sitter with the chair conforming easily to a variety of body shapes.

Among features now incorporated into today's chairs are tilting mechanisms which allow the seat and back to tilt relative to a stationary base of the chair. There are many prior art examples of such arrangements.

U.S. Pat. Nos. 4,314,728 (Falks) and 4,494,795 (Roossien et al) are examples of chairs in which the chair back and the chair seat both tilt, and generally tilt together but at different rates. The back tilts at a faster rate so that as one tilts back, the user is less likely to have his feet lifted off of the floor by the rising front edge of the chair seat.

Other common types of chair controls include one attached to the seat only such that the chair and back tilt at the same rate or one attached to the back only such that the back tilts but the seat remains stationary.

U.S. Pat. No. 4,756,575 (Dicks) shows the use of springs in a frame assembly for a chair which has a backrest that is pivotal with respect to the seat of the chair.

U.S. Pat. No. 4,735,301 (Pergier et al) relates to a seat pitch adjustment assembly which a user can adjust upwardly or downwardly to limit the backward tilt of a chair seat.

U.S. Pat. No. 4,709,963 (Uecker et al) relates to an adjustable office chair to allow an adjustable tilt positioning of the backrest relative to the seat.

U.S. Pat. No. 4,720,142 (Holdridge et al) relates to a variable backstop provided for tilt back chairs, such as the type having a stationary support and a back which tilts with respect to the support.

All of these prior art examples permit backward tilting of a seat and chair back, either together, separately or together at differing rates. However, none of these chairs also include the ability to tilt a seat forward in the context of the same mechanism used to permit the seat to tilt backward.

There is thus a need for a chair tilt mechanism which permits forward and rearward tilting of a chair seat and a chair back in the context of the same mechanical mechanism. The present invention is directed toward filling that need.

SUMMARY OF THE INVENTION

The present invention relates to a tilt control mechanism that is mounted to the underside of a chair bottom, and permits the user or sitter to selectively control the chair height, as well as the degree of chair tilt. A tension adjustment mechanism is provided to permit the user to change the amount of spring tension exerted against the chair bottom when the chair is tilted back. Finally, a structural support is provided which interconnects the seat bottom with the tilt mechanism, and transmits downwardly-exerted weight to the mechanism. Each of these mechanisms comprises a number of parts seated within a die cast enclosure or housing.

The structural support system comprises a rectangular seat mounting plate which is fastened to the exterior underside of a chair shell by two seat support plates. The seat support plate covers the die cast housing. A lockbar is secured to the center underside of the mounting plate, and the lockbar projects downwardly into the die cast enclosure and is positioned within two upwardly projecting fins within the enclosure. The mounting plate is provided with two downwardly projecting sides which rest within the sides of the enclosure. The mounting plate sides and the die cast enclosure sides contain bores to receive a seat support axle. This arrangement ensures that the seat bottom is securely fastened to the tilt mechanism, and that weight is evenly distributed across the tilt mechanism without interfering with the operation of the parts contained within the enclosure.

The tension adjustment mechanism comprises the following parts: A double torsion spring having twin coils connected by a spring arm is seated within the enclosure such that the tilt mechanism mounting plate is seated upon the spring connecting bar. Disposed within each coil of the double torsion spring is a support bushing axially aligned with the spring coils. The support bushings rest on the back support axle placed in axial alignment with the support bushings and the torsion spring coils. The back support axle is rotatably mounted within the sides of the enclosure.

The double torsion spring contains two legs that are engaged by a crossbar forming part of a tension lever that is pivotally mounted to the housing. A tension shaft is in threaded engagement with a pivot pin forming part of the tension lever. Rotating the tension knob rotates the threaded tension shaft within the threads of threaded pin. The threaded pin, and the tension arms to which it is secured, can be moved either upward or downward depending on whether the tension knob is rotated clockwise or counterclockwise. Upward movement forces the tension points of the crossbar against the legs of the double torsion spring, thus increasing the tension in the spring. Since the connecting arm of the double torsion spring is secured to the seat mounting plate, and since the protruding legs of the double torsion spring are mounted underneath the crossbar of the tension lever, downward movement of the forward end of the tension lever increases the spring tension developed between the double torsion spring and the mounting plate.

The tilt mode selection mechanism comprises the following parts. A spiral tilt stop is provided which is rotatably mounted within the die cast enclosure, and includes a bottom geared portion which projects downward at the bottom plane of the enclosure. The top portion of the spiral tilt stop includes a plurality of positive detents disposed spirally around the circumference of the tilt stop. Thus, rotating the tilt stop causes the height of the tilt mechanism to vary depending upon which detent is engaged by the tilt mechanism.

The bottom geared portion of the tilt stop engages a mode selector rack in which is rotatably mounted a mode selector and mode selector lever. The mode select lever and mode selector are rotatably mounted within a mode selector enclosure disposed below the underside of the die cast housing. The mode selector is provided with a forward projecting tab. The tab engages and presses against a lock plate which in turn presses against the mode select spring mounted on the mode selector enclosure. Moving the mode select handle alters the position of the spiral tilt stop and, through interaction with a lockbar mechanism and a cam on the seat mounting plate, alters the tilting properties of the chair.

The gas lift adjustment mechanism comprises the following parts. A gas lever spring is secured, facing upward, to the interior cast portion of the enclosure. The spring is engaged by a gas spring lever and an associated extension lever having a gripping handle disposed outside the tilt mechanism.

It is thus a primary object of the present invention to provide a control mechanism for adjusting a chair seat and a chair back in a variety of relative positions.

It is another object of the present invention to provide a chair tilting mechanism for controlling a chair seat and a chair back in an articulated control.

It is still an object of the present invention to provide seat and back control in a chair to a mechanism that incorporates a four-bar link.

It is yet another object of the present invention to provide a chair made of a unitary shell that defines a seat and back, and which includes a mechanism for allowing relative adjustment between the seat and back.

These and other objects and advantages will be more fully understood and appreciated by reference to the written specification and appended drawings.

DETAILED DESCRIPTION OF THE PREFERRED EMBODIMENTS

Figure 1:
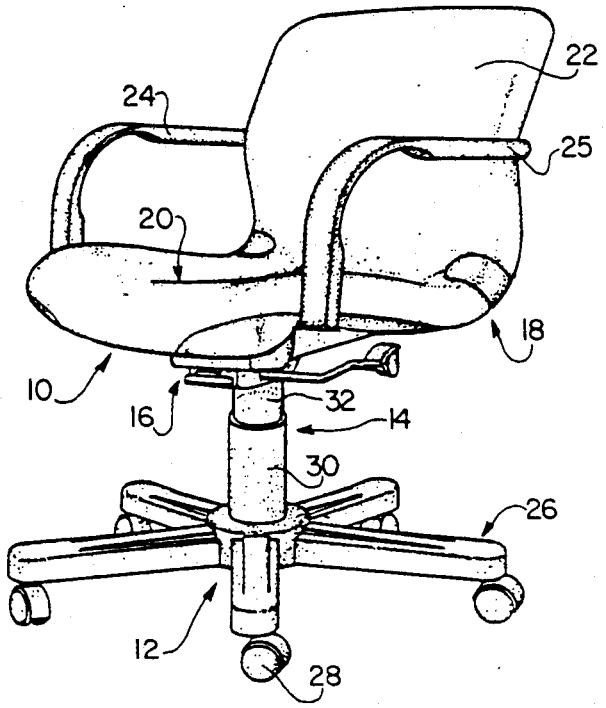
FIG. 1 is a perspective view of a chair incorporating the inventive chair tilt and chair height control apparatus.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

The present invention relates to a tilt control and adjustment apparatus embodied in a chair. The present invention also relates to the way in which relative movement is controlled between the chair seat and the chair back during forward and rearward tilting operation of the chair.

Figure 2:
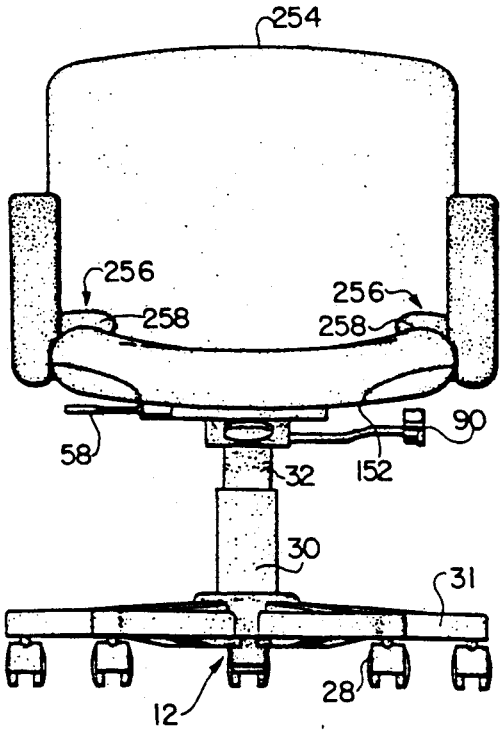
FIG. 2 is a front view of the chair of FIG. 1.
Figure 3:
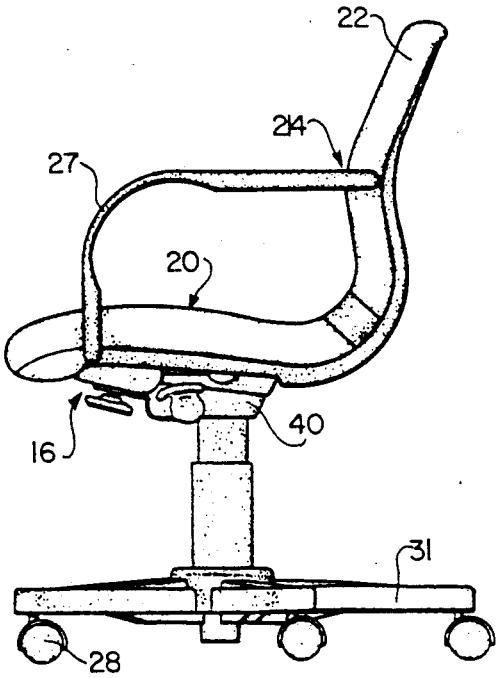
FIG. 3 is a side view of the chair of FIG. 1.

With reference to FIGS. 1, 2 and 3, a chair embodying the teachings of the present invention is generally designated as 10, and basically consists of a base 12 that supports a height adjustment mechanism 14. A tilting mechanism 16 is secured to the height adjusting mechanism. In turn, a one-piece chair portion 18 is secured to the tilt mechanism 16. The chair portion defines a chair seat 20 and a chair back 22. The chair seat and chair back are formed as an integral unit in a manner to be described in greater detail hereinafter. Attached on either side of the seat are a pair of arms 24 and 25 that each include flexible center portions 27. One end of each arm is connected to the seat 20 whereas the other end of each arm is connected to the chair back 22. It is contemplated that in an alternative embodiment of the present invention, the arms may be eliminated.

As shown in FIG. 1, the base 12 of the chair consists of a conventional five-point chair pedestal 26 with the center of the pedestal supporting the height adjustment mechanism 14. The ends of each leg 31 of the pedestal support a conventional caster 28 in order to facilitate movement of the chair along the ground.

The height adjustment mechanism 14 consists of a conventional pneumatic-type height adjustment structure. In a preferred embodiment, suitable height adjustment structures are made by Suspa and Stabilus. It is also contemplated that non-pneumatic conventional mechanical height adjustment structures may also be used. In the embodiment of FIG. 1, the mechanism 14 includes an outer shell 30 and an inner cylinder 32 which moves along the longitudinal axis of the outer cylinder 30 in order to move the chair portion 18 toward and away from the ground. As will be explained hereinafter, the chair includes a handle 58 for controlling a pneumatic mechanism for releasing the tube 32 relative to the tube 30 to allow repositioning of the chair portion 18.

Figure 4:
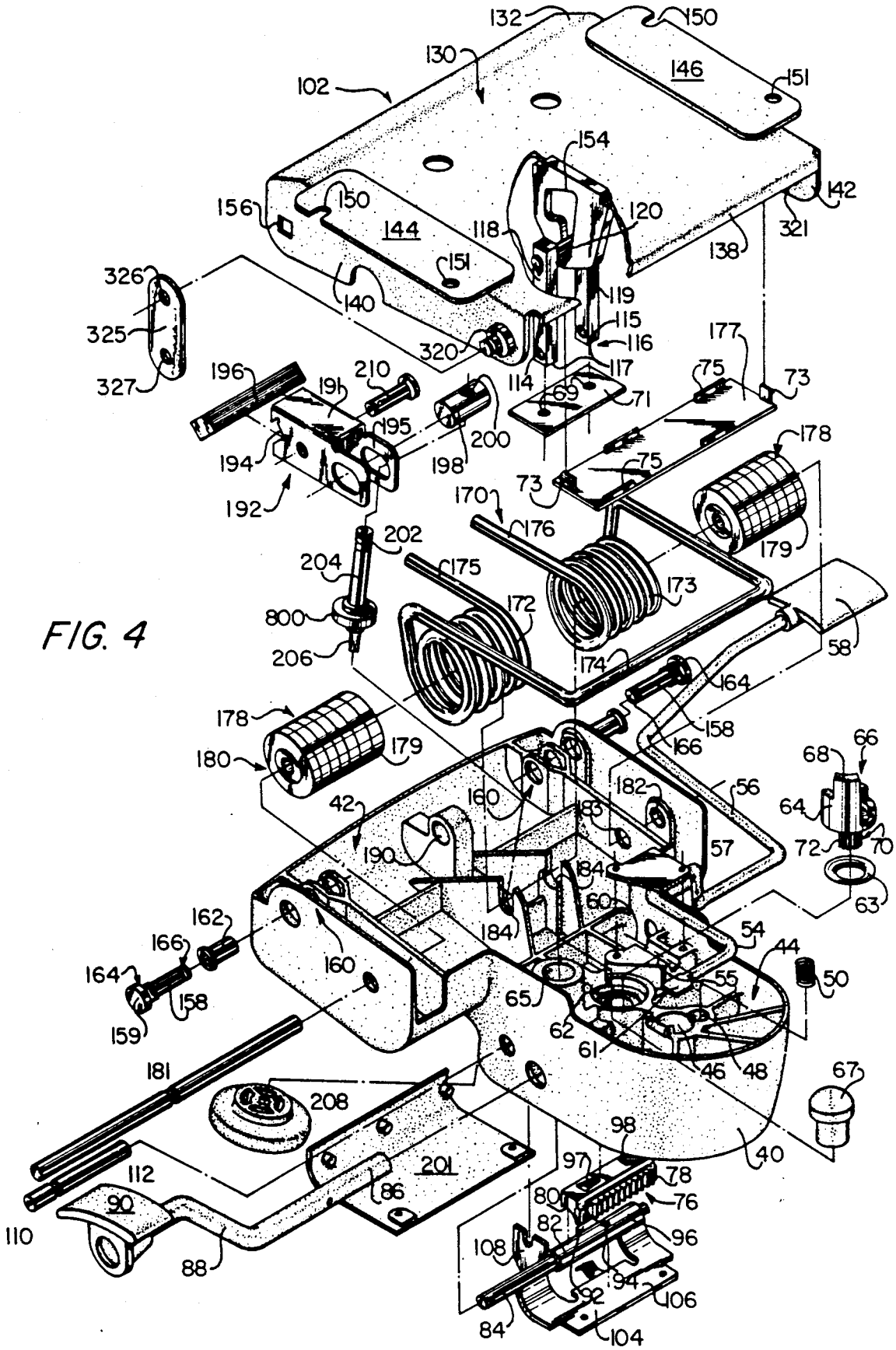
FIG. 4 is an exploded view of the tilt and chair height control mechanism found in the chair of FIG. 1 with certain parts removed for clarity.

With reference to FIGS. 4 through 8, the details of the tilting mechanism 16 will now be described. At the heart of the tilting mechanism is a die cast enclosure or housing 40. The housing is generally divided into a broad forward portion 42 and a narrower rearward portion 44. Located at the back end of the rearward portion of the housing is a through bore or cylinder 46 within which is received a portion of the height adjustment mechanism 14. Adjacent to bore 46 within the housing is a further bore 48 which receives a compression spring 50. Movably positioned within the housing is a gas spring lever 56 made up of a gas spring lever portion 54 positioned within the housing and extending (now one part instead of two) outside of the housing. The gas spring lever 56 terminates at its free end in an activation handle 58. As shown in FIG. 4, movement of the handle 58 in an up-and-down motion causes rotation of the gas spring lever 54 about a rotation axis 60 defined within the housing to cause the gas spring lever 54 to be pressed into engagement with the gas lever spring 50. The compression of spring 50 permits terminal end 61 to press against the release portion or actuator 207 of the height adjustment mechanism 14. When the handle 58 is released, spring 50 returns to its normal position and urges end 61 away from the actuator 207.

Positioned forward of and adjacent to cylinder 46 within housing 40 is a further bore 62 which receives a spiral tilt stop 66 that sits on top of a curved spring washer 63. With continued reference to FIG. 4, the spiral tilt stop consists of an upper cylindrical portion 64 that contains a series of steps or detents 68 of varying heights. The bottom of the spiral tilt stop consists of a gear 70 including a plurality of gear teeth 72 that circumscribe the gear 70.

Positioned within a channel 74 located in the lower part of the rear portion 44 of the housing 40 is an elongated plastic mode selector rack having a side portion 76 that consists of a series of adjacent teeth 78 that are arranged and configured to mesh with the teeth 72 of the spiral tilt stop. As oriented in FIG. 4, the underside of mode selector rack 76 defines a concave longitudinally extending cylindrical surface 80. This surface mates with, and is received on, a cylindrically-shaped mode selector 82. The mode selector 82 contains an elongated pin 84 that is also received within the hollow portion of a mode selector lever 86 which contains an angle bend 88 which terminates in a handle 90. There is a mechanical connection between the pin 84 and the hollow portion of the mode selector lever 86. The mode selector 82 contains an outwardly projecting tabs 92, 94 and 96.

The selector rack 76 is movably mounted on the mode selector 82 and the relative movement between the rack and the mode selector is controlled by projection 96 defined on the mode selector. In particular, projection 96 is received in transverse slot 98 of mode selector rack 76. This ensures linear motion of the selector rack while permitting rotary motion of the mode selector 82. A further projection 94 is defined on mode selector 82 and positioned a predetermined distance from projection 96. An inwardly projecting finger 97 on the mode selector rack 76 acts as a detent spring against projection 94 for handle 90.

Figure 6:
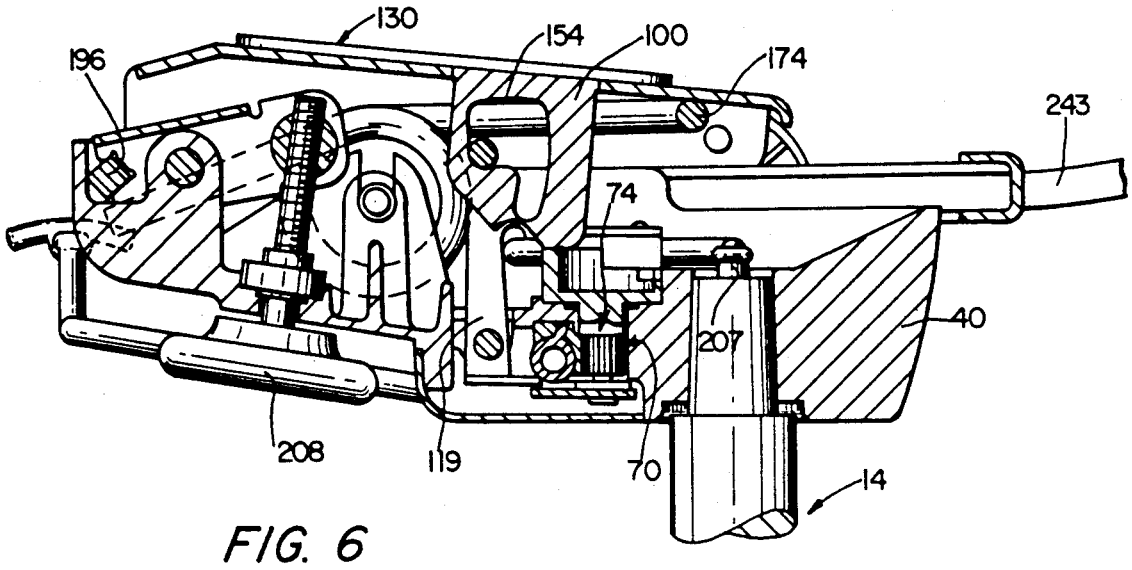
FIG. 6 is a view taken along lines 6—6 of FIG. 5.
Figure 7:
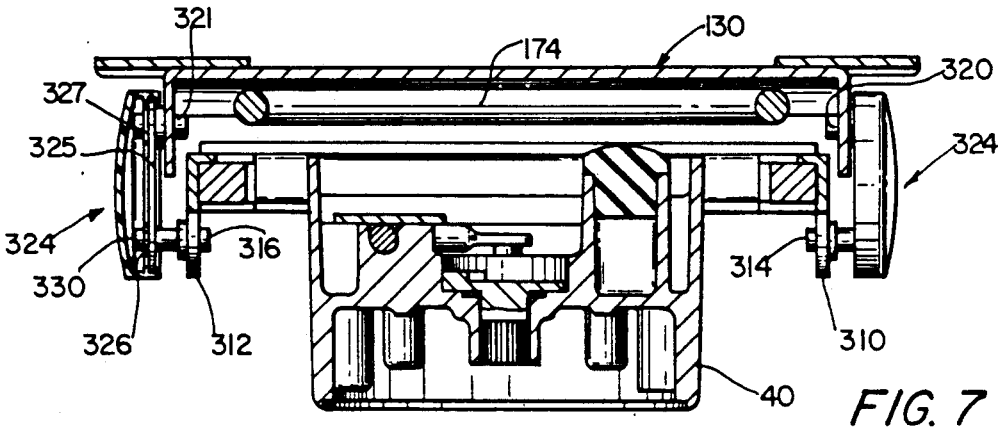
FIG. 7 is a view taken along lines 7—7 of FIG. 5.
Figure 8:
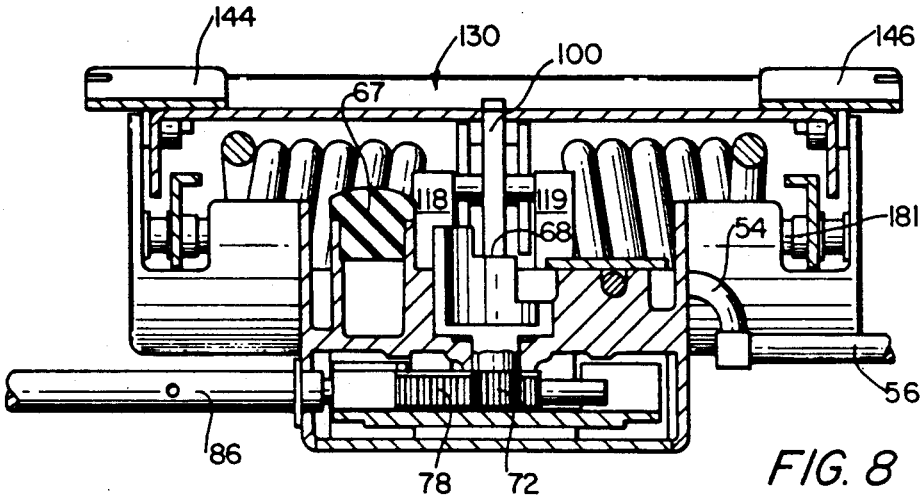
FIG. 8 is a view lines 8—8 of FIG. 5.

With reference to FIGS. 4, 6 and 8, when the handle 90 is moved in a direction toward the housing then the mode selector 82 is urged in the same direction of movement to cause the rack 76 to move in the same direction under the guidance of projection 96. As the rack moves, it causes the spiral tilt stop to rotate because of the meshing engagement between the teeth 72 of the spiral tilt stop and the teeth 78 formed on the rack. This, in turn, causes the spiral tilt stop to rotate so that one of the steps 68 is positioned for engagement with the underside of a cam member 100 defined on the underside of a seat mounting plate 130.

The gas spring lever 54 is movably positioned within a trough 55, and is held in place by a planar cap or plate 57 which is secured to the top of the trough by suitable fasteners, such as screws (not shown). The positioning of the gas spring lever 54 within the trough 55 provides longitudinal axis 60 about which the lever rotates in order to activate the pneumatic control in the height adjustment member 14. On the opposite side of the housing in line with plate 57 is a bore 65 for receiving a resilient stop 67 to dampen the stopping motion at the end of the full recline by the tilt mechanism.

A mode selector enclosure 104 supports a mode selector spring 106. The mode selector enclosure 104 is positioned on the underside of the rearward portion 44 of the die cast enclosure 40. The bottom of housing 40 is finished by enclosure plate 201. The end 112 of the lockbar axle is mounted within an aperture defined within the enclosure 40. This arrangement supports the axle for rotation. The axle passes through bores 114 and 115 defined in the distal ends of the legs of a lockbar 116. As shown in FIG. 4, the lockbar contains two vertically extending legs 118 and 119. Each leg contains a transverse extending bore that receives a cam follower in the form of an elongated cylindrical member 120. The other ends of each leg contain the bores 114 and 115 which, as stated before, receive the lockbar axle 110. The lockbar 116 contains holes or bores 117 defined on the underside of each lockbar leg. A metallic lock plate 71 is of rectangular shape and includes a pair of holes 69 that mate with holes 117. In this way, the plate 71 is secured to the underside of the lockbar legs through the use of suitable fasteners, such as screws (not shown).

A seat support 102, as oriented in FIG. 4, consists of a generally planar mounting plate 130 having a top surface 132 and a bottom surface 134. The forward and rearward portions of the mounting plate 130 consist of downwardly projecting lips 136 and 138. The left and right sides of the member consist of downwardly projecting fins 140 and 142, respectively. A plastic elongated planar member 177 contains edge projections 73 and 75 to facilitate mounting of the member 177 to the underside of plate 130 near lip 138.

Secured as by welding to the left and right sides of the upper surface 132 are a pair of seat support plates 144 and 146. Each support plate contains pairs of openings 150 and 151 which receive suitable fasteners such as screws (not shown) in order to secure the seat mounting plate to the underside 152 of the unitary chair structure 18. Near the central portion of the mounting plate 130 is the downwardly projecting cam member 100 which contains a cutout cam surface 154 in a closed geometric pattern for guiding the follower 120 of the lockbar in order to facilitate movement of the chair unit 18 in forward and rearward tilting motions. The forward end of the mounting plate at sides 140 and 142 contains cutouts 156 which receive seat support axles 158 that are positioned within a series of bores 160 defined on the left and right sides of the forward portion 42 of the housing 40. The support axle 158 is movably mounted within a bushing 162 that is also positioned within each of the bores 160.

Figure 5:
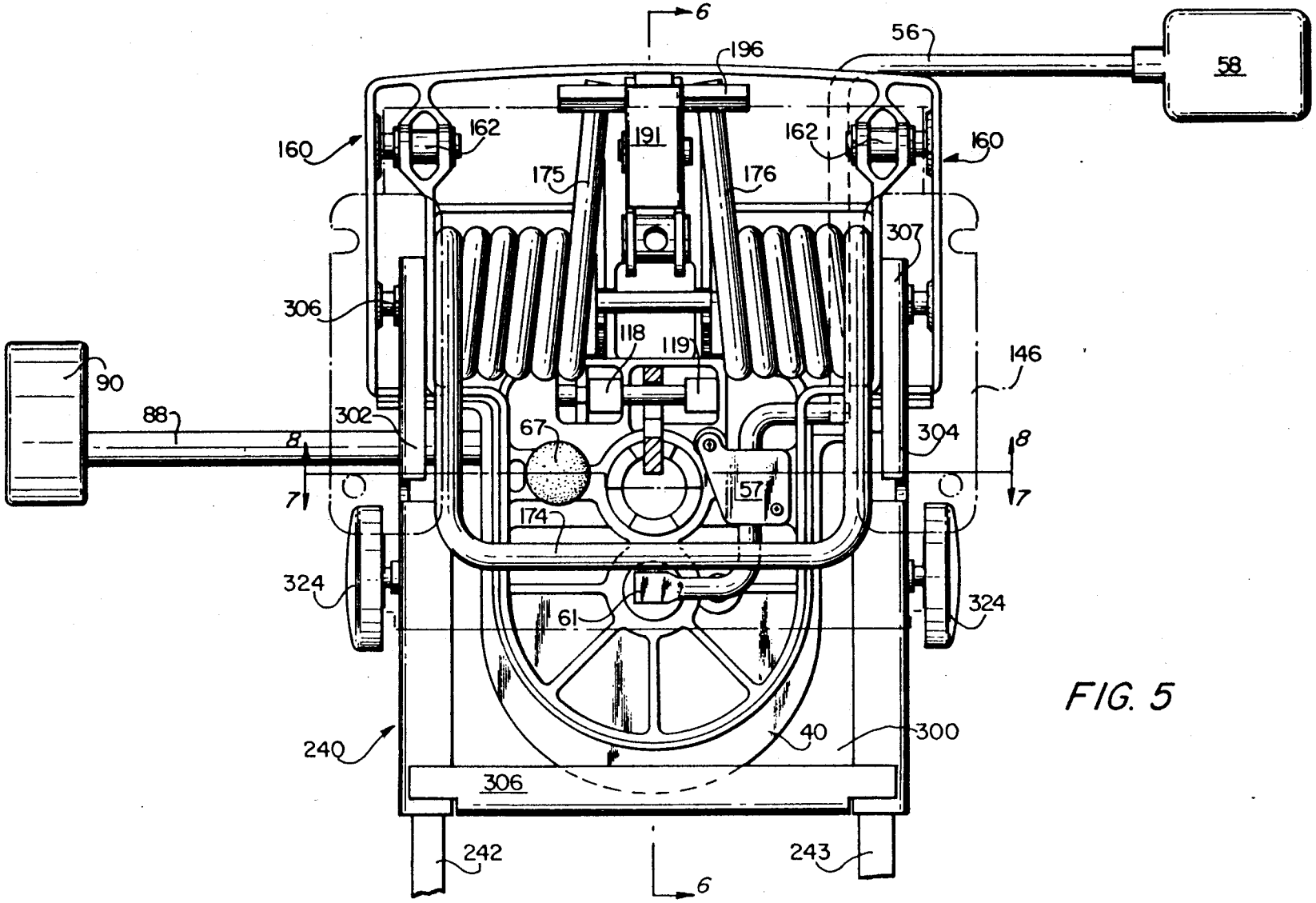
FIG. 5 is a top view of the mechanism of FIG. 4 with the seat mounting plate in phantom.

As shown in FIGS. 4 and 5, the head end of the axle 158 below end cap 159 contains a generally square-shaped portion 164 that mates with the cutout 156 defined in the mounting plate. The other end of the axle terminates in a circumferential groove 166 that receives a suitable lock washer for securing the seat support axle in place within the bushings 162 defined within the housing 40.

The spiral tilt stop 66 sets on top of wave washer spring 63 in the bore 62 of the die cast housing 40. The purpose of the wave washer is to slightly lift the spiral tilt stop so that it is resting only on the peaks of the washer and has less surface area for contact which enables it to rotate easier. When the stop is engaged weight compresses the wave washer allowing the full surface of the spiral stop 66 to contact the bottom of enclose bore 62 increasing the friction to prevent accidental rotation. Depending upon the relationship between the steps 68 of the spiral tilt stop and the lower edge of the cam 100 attached to the seat support plate 130 the tilt rang is either restricted or locked in place preventing any tilting.

The lower gear portion 70 of the spiral tilt stop 66 protrudes through the casting and extends vertically into the mode selector cavity after passing through bore 62. Engaged with this pinion gear is the plastic mode selector rack 76 which slides freely from side-to-side in a slot in the housing 40. As explained before, the mode selector rack is keyed through slot 98 and projection 96 so that its only motion is linear, and the gear teeth 78 are always engaged with the teeth 72 of the spiral tilt stop. Integral to the mode selector rack is the small leaf spring 97 which engages the mode selector 82 at projection 94.

The mode selector 82 has one round pin 96 extending perpendicularly from the barrel that engages transverse slot 98 in the mode selector rack 76. This pin keys the parts together so that they move together linearly and the mode selector can rotate within the mode selector rack. The small tab 94 on the mode selector 82 engages the integral spring 97 of the mode selector rack 76 when it is rotated acting only as a detent for the handle position. All of the parts are trapped within the casting 40 cavity by the mode selector enclosure 104.

The mode selector enclosure has a metal spring 106 attached to it. The free end of the spring engages the plate 71 attached to the bottom of the lockbar 116. This spring is always under tension. For this reason it is preferably metal to avoid creep failure which would result if it was plastic.

The mounting plate 130 is placed under tension through the use of a double torsion spring 170. The torsion spring consists of two coiled spring portions 172 and 173 which are joined together through a spring connecting bar 174. Each of the spring portions terminate in an outwardly extending leg 175 and 176. The coil spring portions 172 and 173 each receive a support bushing 178. In a preferred embodiment, the support bushing is made up of a series of plastic cylindrical segments 179 that are conventionally fastened together, such as by snap fit. The support bushings contain longitudinally extending axial bores 180 that receive a back support axle 181. The back support axle is positioned within the rearward/forward portion of the housing 42 in a series of aligned bores 182, 183 and 184 defined on both sides of the housing. The support bushings support the spring coils 172 and 173 as the coils deflect and, thus, increase spring life.

Positioned within the forward portion 42 of the housing 40 and secured to an upwardly extending boss 190 defined within the housing is a spring tension control mechanism 192. The mechanism basically consists of a tension lever 191 which contains a pair of spaced parallel tension arms 194 and 195, the forward ends of which contain cutouts for receiving a welded crossbar 196. The crossbar 196 is elongated and is generally square in cross-section. The rearward portion of each tension arm contains a cutout which receives a threaded pin 198 that contains a threaded shaft hole 200 for receiving one end 202 of a tension shaft 204.

The crossbar 196 is positioned within the housing so that the pair of legs 175 and 176 of the double torsion spring are located below the crossbar within the housing 42. The free end 206 of the tension shaft projecting through thrust bearing 800 receives a tension control knob 208 which is operated by the user or sitter in order to cause the tension shaft to move within the threaded shaft hole defined in the pin 198. An axle 210 is provided for mounting the tension arms to the boss 190 and provides a pivot point for the tension lever. Rotation of the tension knob causes the tension lever to pivot about the axle 210 and, thus, adjust the amount of tension exerted by the crossbar 196 on the legs 175 and 176 of the spring 170. As the tension increases, it can be seen that the spring portions 172 and 173 will rotate about the support bushings in order to place greater tension on the mounting plate through the spring cross member 174.

Also forming part of the tilting mechanism is a tilt control back link 240. With reference to FIGS. 5, 7, 9A and 10, the back link comprises a generally horseshoe-shaped member 300 having two generally parallel and spaced legs 302 and 304. The back ends of each leg are joined by a cross member 306. The back half of each leg also contains side and top portions generally resembling an L, to which is welded the legs 242 and 243 of a J-bar structure. The forward end of each leg includes a bore 306 and 307, respectively, for pivotal mounting to the back support axle 181. The mounting portions of each leg are received within a spaced defined between the ends of the support bushings and the outer portions of the housing 40.

Near the backs of the sides of each leg 302 and 304 are tabs 310 and 312 which contain outwardly projecting axles 314 and 316. Near the rearward portion of the sides 140 and 142 is a pair of outwardly projecting axles 320 and 321. A link member 325 contains a pair of spaced apertures 326 and 327 which are spaced at a predetermined distance and receive the axles 320 and 314 on one side of the mounting plate 130 and back link 240. Another link member 325 has similar apertures 326 and 327 mounted on the other side of the mounting plate and the back link. The axles 314, 316, 320 and 321 are secured in place by a mechanical means, such as welding or orbital riveting to side plates 140 and 142 and back plates 310 and 312. A suitable locking ring attaches link plates 325 to pins 314, 316, 320 and 321.

Figure 9A:
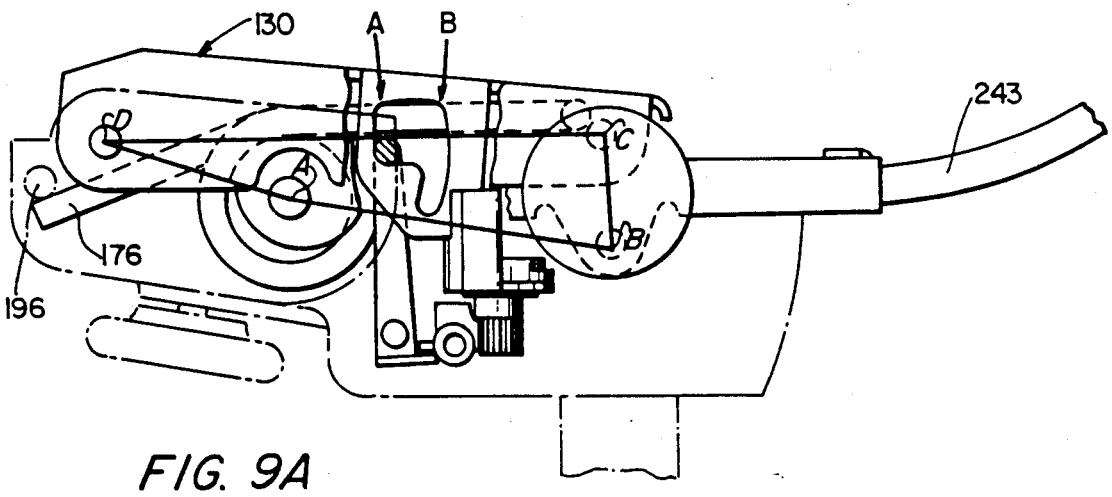
FIGS. 9A through 9C are schematic drawings used to illustrate the operation of the tilting mechanism.
Figure 9B:
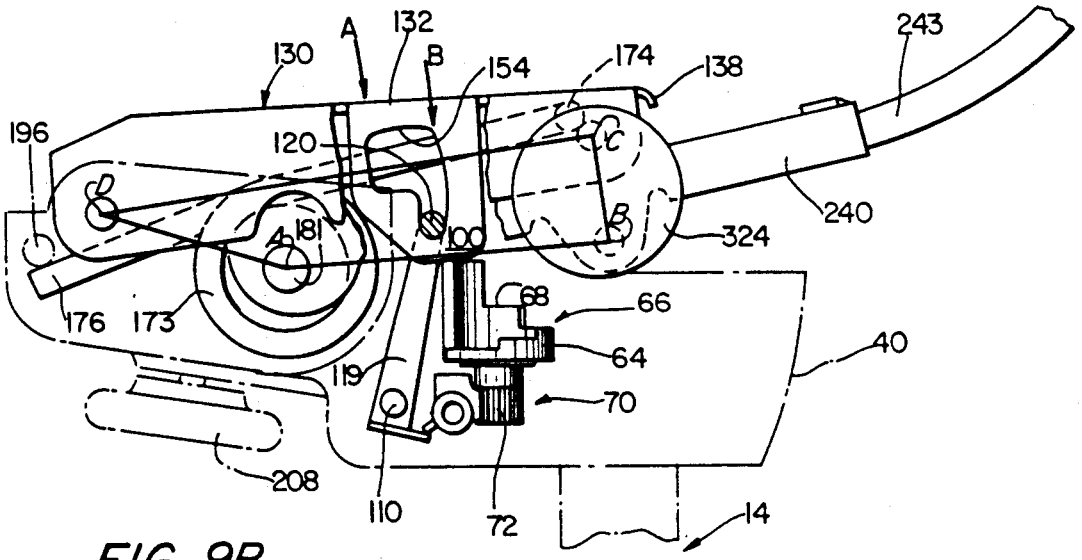
Figure 9C:
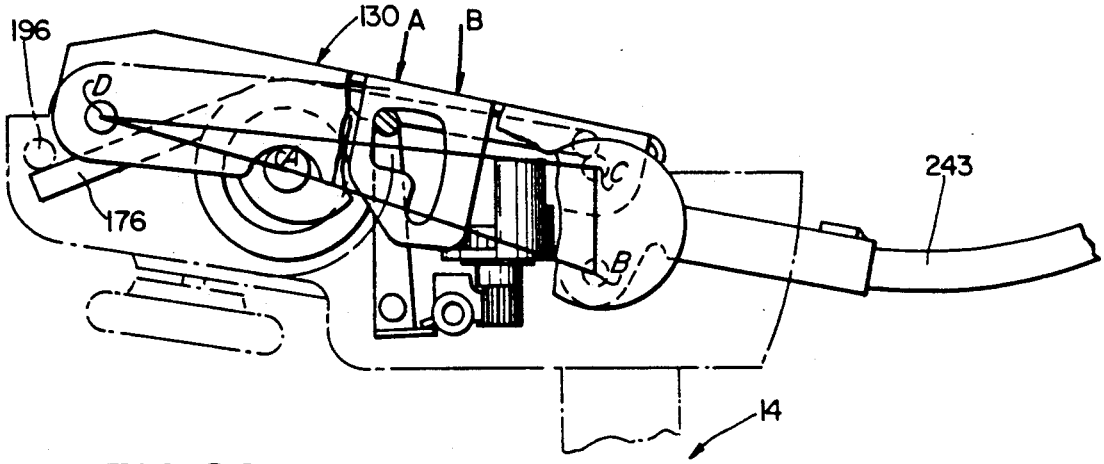

With reference to FIGS. 9A, 9B and 9C, the operation of the tilt mechanism and the relative movement between the seat and the chair back will now be described. FIG. 9A illustrates in section the major elements acting in the tilt mechanism. FIG. 9A also shows the tilt mechanism in its normal or at-rest position, which will support the seat and chair back in their customary orientations. FIG. 9B shows the tilt mechanism in its extreme forward tilt orientation which aligns the front end of the seat in a downward direction and brings the chair back so that its top end tilts slightly forward. FIG. 9C shows the tilting mechanism in its most rearward position to give maximum tilt to the seat and maximum backward tilt to the chair back.

As can be seen with reference to FIGS. 9A through 9C, the basic tilting mechanism revolves around a four-bar link consisting of links AB, BC, CD and DA. The four-bar link also includes four pivot positions A, B, C and D. Pivot A is defined by the back support axle 181. Pivot B is defined by the pivot point 314 defined in the side portion of back plate 310 or back link 240. Pivot C is defined by the aperture 320 defined in the side portion 140 of the mounting plate 130. Finally, Pivot D is defined by the seat support axle 158. The four-bar linkage is used to distribute the spring force through the mechanism in such a way as to evenly support the sitter. In addition, the four-bar linkage governs the ratio at which the chair back 22 moves with respect to the chair seat 20. This also allows the back to come forward and support the sitter in the forward tilt position.

With further reference to FIGS. 4 through 10, the tilt mechanism operates in the following manner. The crosspin 120 of the lockbar 116 rides in one of two tracks (see arrows marked A and B in FIG. 9A) in the cutout of the cam 100 attached to the seat support plate. The spring 106 attached to the mode selector enclosure presses against the plate 71 attached to the bottom of the lockbar 116 forcing the lockbar to normally ride in the shorter cam track A. This shorter track is the normal tilt range from at rest mark to full recline (FIG. 9C). The lower edge of track A mark the at rest position for the tilt mechanism. When in the at rest position, the mode selector 82 and rack 76 can be pushed in fully spinning the spiral tilt stop 66 until the second highest step rests under the cam. This effectively locks the chair in the at rest position and prevents any tilt motion. If the mode selector 82 is only pushed partially in then the tilt travel range is reduced depending upon the height of the step on the spiral tilt stop that is located underneath the cam.

A forward rotation of the mode selector places the tilt mechanism in the forward tilt position (FIG. 9B). The crosspin of the lockbar is now riding in the longer cam track B with the lower edge of the track locating the mechanism in the forward tilt position. With the mode selector rotated forward, the tilt mechanism can travel freely from forward tilt to full recline. The integral spring 97 in the mode selector rack 76 acts as a detent which keeps the mode selector in the rotated position. As in the other mode, the in-out motion of the mode selector controls the tilt travel restrictions by rotating the spiral tilt stop. The highest step of the spiral tilt stop locks the chair in the forward tilt position. As a side benefit, if the mode selector is rotated back to its normal position while the chair is in the forward tilt position the spring 106 of the mode selector enclosure 104 acting on the lockbar plate 71 will force the lockbar back into the small cam track automatically the first time the chair is reclined back past the at rest position. The chair is then back in the normal mode and the mode selector must be rotated again to access the forward tilt position.

Figure 10:
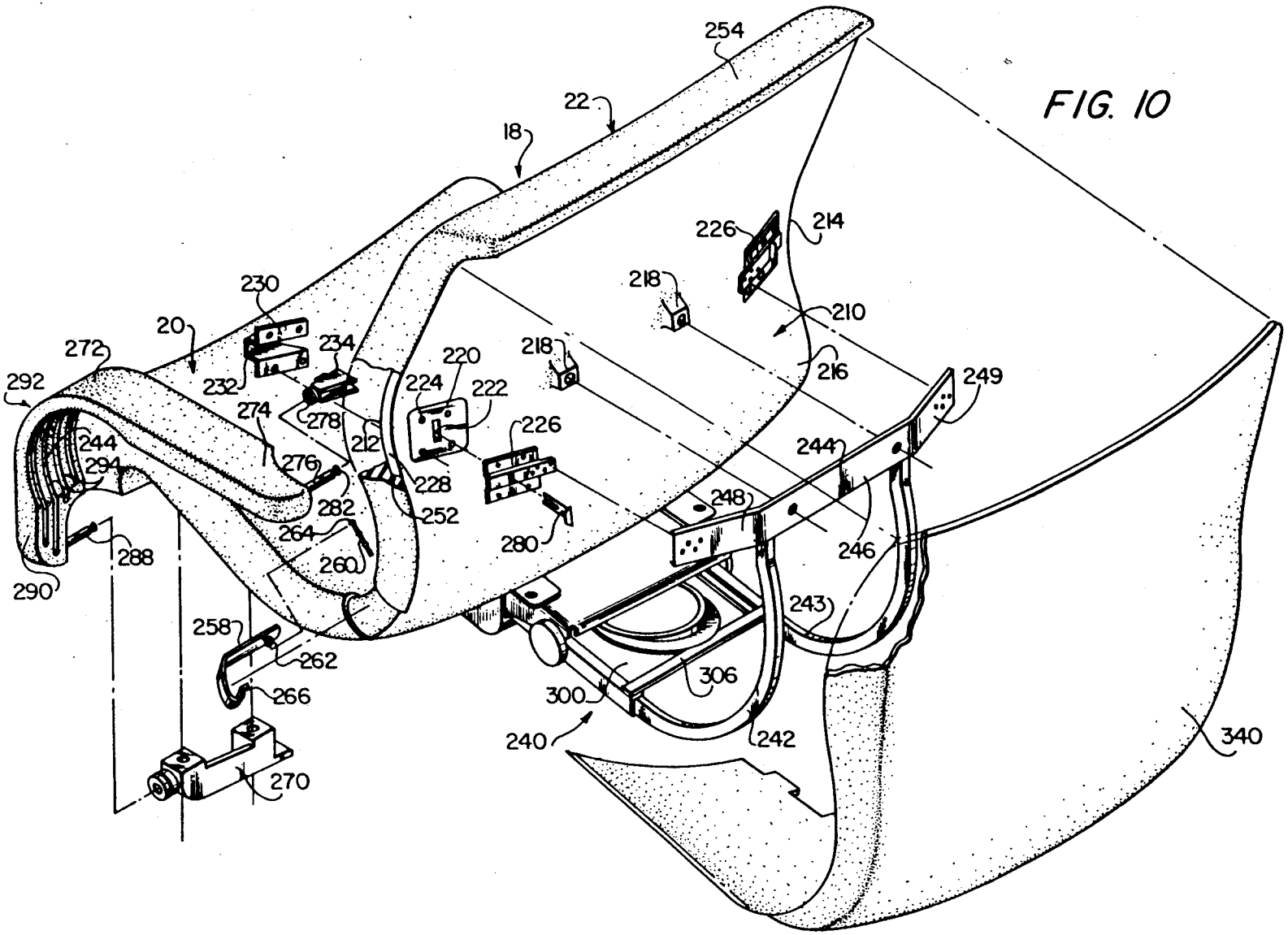
FIG. 10 is an exploded view of the elements found in the unitary shell structure for the chair of FIG. 1.

As shown in FIG. 10, in a preferred embodiment, the tilt mechanism is incorporated into the entire chair structure, and the chair structure is appropriately configured to interact with the tilt mechanism. In particular, chair section 18 consists of a unitary structure having a seat area 20 and a chair back area 22. The chair structure 18 essentially comprises a flexible inner structural shell 210 made of glass reinforced polypropylene in a form generally conforming to the desired configuration of the seating area. In particular, the front surface 212 defines a generally concave seat portion and a generally straight back portion with the transition from the seat area to the back portion deviating from planarity in a smooth and continuous fashion, and defining a lumbar support section 214.

The inner surface or back 216 of the flexible inner structural shell 210 contains a series of attachment points generally aligned along the lumbar support section 214 of the chair. As shown in FIG. 10, the attachment points consist of a pair of outwardly extending bosses 218 and a pair of planar attachment areas 220. Each of the attachment areas contains a through bore or cutout 222 extending through the structural shell. There are also provided a series of bores 224 for receiving fasteners in a manner to be described hereinafter. Each planar attachment area 220 receives a securing plate 226 on the inner surface of the shell. At the same time, a complementary planar surface 228 is defined on the outer surface 212 of the structural shell for receiving an arm mounting plate 230. Both plates 226 and 230 contain apertures for receiving fasteners that are also passed through the bores 224 defined in the structural shell. The mounting plate 230 contains a channel or trough portion 232 for receiving an arm mounting member 234.

The tilt control back link 240 terminates at its rearward end in the pair of J-bars 242 and 243. The J-bars in turn terminate in a unitary cross member 244 that consists of an elongated straight portion or strip 246 and two shorter inwardly bent portions or strips 248 and 249. The relationship between the portions 246, 248 and 249 is such that they are bent relative to each other so that they mate with the bosses 218 and the mounting brackets 226 found on the flexible inner structural shell 210. Through portions 246, 248 and 249 the tilt control link is fixedly secured to the inner structural shell through suitable fasteners, such as screws (not shown). An unadorned cosmetic outer shell 340 made of polypropylene covers the back and bottom of the chair portion 18. The shell 340 is secured to the inner shell 210 by snap fasteners, often referred to as "Christmas tree" fasteners because of the series of barbed edges provided along the shaft of the fastener. In place, the shell 340 is spaced from the back surface 216 of the inner shell 210 to define a space within which the J-bar can move as the inner structural shell 210 flexes. In use, the structural shell 210 flexes uniformly between where the shell is attached to the tilt mechanism in the seat area and to the J-bar by strips 244, 248 and 249.

The outer smooth surface 212 of the structural shell receives a suitable padding or foam cushion 252 that is secured to the outer surface with a conventional adhesive A fabric 254 is then placed over the foam cushion and is secured to the cushion by adhesive. As shown in FIGS. 1, 2 and 3, fabric is gathered at either side of the chair portion 18 in an area 256 where the transition between the seat and the back takes place. The material 254 is cut and trimmed in that area to remove any wrinkles from the remainder of the seat. A cosmetic clip 258 is placed over the gathering point of the material in order to eliminate from view any possible seam created at that point and to provide an aesthetically pleasing view to the user.

The clip 258 is secured in place in the following manner with reference to FIG. 10. A pin 260 is secured to a suitable opening defined in the inner structure shell 210. Clip 258 contains at one end a hook portion 262 that receives the head of the pin 260 and, thus, holds that portion of the clip 258 in place. The other end of the clip terminates in a hook portion 266 that is configured to staple into place on the underside of the structural shell.

Also positioned along the underside of the shell near the forward end of the shell is an arm mounting member 270. As shown in FIG. 10, an arm 272 contains a rearward end 274 terminating in an extension pin 276 that is received within a bore 278 defined in mounting member 234. A retaining clip 280 passes through the cutout 222 in the shell and affixes itself to a circumferential groove 282 on the mounting pin 276. In this way, the arm is secured to the structural shell. In a similar manner, a mounting pin 288 defined at the lower end 290 of arm 272 is mounted to the mounting member 270. The arm 272 contains a central portion 292 that joins the rearward and lower portions of the arm. The central portion is made up of a series of segmented members that allow that portion of the arm to flex.

From the above, it is apparent that many modifications and variations of the present invention are possible in light of the above teachings. For example, as designed, the forward tilt feature is integral to the tilt mechanism and yields a fully functional mechanism with forward tilt and tilt lock in the forward tilt and at rest positions in addition to having the adjustable rear tilt stop. By changing the shape of the plate 71 attached to the bottom of the lockbar 116 the travel of the lockbar can be restricted so that it only rides in the short cam track A. This provides an intermediate mechanism which does not have forward tilt but has an at rest tilt lock and adjustable rear tilt stop. By removing the spiral tilt stop, the mode selector, the mode selector enclosure and the mode selector rack yield a basic mechanism. This mechanism has only the normal tilt range and no tilt locks or adjustable stops. Thus, it can be seen that the present mechanism offers a multi-purpose mechanism that may be easily altered by removing selected parts.

Further, the tilt mechanism may be incorporated into multiple-piece chairs, such as that disclosed in U.S. patent application Ser. No. 07/465,340, entitled HEIGHT ADJUSTMENT MECHANISM FOR CHAIR BACK, filed on even date herewith, assigned to Knoll International, Inc. the same company as the present application, and incorporated by reference herein.

It is therefore to be understood that, within the scope of the appended claims, the invention may be practiced otherwise than as specifically described.

What is claimed is:

1. A tilt mechanism for a chair having a seat, a back, and a support base with a top portion, said tilt mechanism comprising:

a housing secured to said top portion of said support base, said housing having a front end and a rear end;

a seat support plate having a front end and a rear end;

means for pivotally securing said front end of said seat support plate to said front end of said housing;

means for securing said seat to a top portion of said seat support plate;

back support means having a front end;

means for pivotally mounting said front end of said back support means to a portion of said housing located between said front and rear ends of said housing;

means for mounting said chair back to said back support means;

an elongated link means for pivotally linking in a spaced relationship, said rear end of said seat support plate and a portion of said back support means positioned rearward of said front end of said back support means;

cam means mounted to said seat support plate and including a cam surface formed in a closed geometric pattern; and follower means movably mounted to said housing and including a follower mounted within said closed geometric pattern, said follower being guided by the cam surface for guiding said chair seat to tilt forward and to recline backward as said seat support plate and said back support means pivot relative to said housing.

2. The tilt mechanism of claim 1, wherein the forward tilting of said seat is a first mode of operation and the backward reclining of said seat is a second mode of operation, and wherein said tilt mechanism further comprising mode selecting means mounted within said housing for controlling the operation of said tilt mechanism in said first and second modes.

3. The tilt mechanism of claim 2, wherein said cam surface includes first and second cam tracks and said mode selecting means sets said follower in said first cam track for reclining operation and sets said follower in said second cam track for forward tilting operation.

4. The tilt mechanism of claim 2, further comprising stop means movably mounted in said housing, said stop means operative in at least one position for locking said seat support plate in at least one predetermined position relative to said housing.

5. The tilt mechanism of claim 4, wherein said stop means comprises step means including a base member rotatably mounted in said housing, a plurality of steps of varying heights secured to said base member, each height representing a predetermined position for said seat support plate, said step means being positioned within said housing so that said steps may be selectively moved into operative relationship with said seat support plate, and means within said housing for operating said step means to move said steps into said predetermined positions.

6. The tilt mechanism of claim 5, wherein said stop means further comprises friction means interposed between said base member and said housing for facilitating movement of said step means, said friction means operating in a first position to enable relatively easy movement of said step means relative to said housing and operating to a second position to make movement of said step means relative to said housing more difficult than when said friction means is in said first position.

7. The tilt mechanism of claim 1, wherein a four-bar linkage is created at the pivotal connection of said front end of said seat support plate to said front end of said housing, the pivotal connection of said front end of said back support means to said housing, the pivotal connection of said rear end of seat support plate to one end of said elongated link means, and the pivotal connection of said rearward portion of said back support plate to the other end of said elongated link means.

* * * * *